US007933415B2

(12) United States Patent
Breebaart

(10) Patent No.: US 7,933,415 B2
(45) Date of Patent: Apr. 26, 2011

(54) SIGNAL SYNTHESIZING

(75) Inventor: Dirk Jeroen Breebaart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1710 days.

(21) Appl. No.: 10/511,798

(22) PCT Filed: Apr. 22, 2003

(86) PCT No.: PCT/IB03/01586

§ 371 (c)(1),
(2), (4) Date: Oct. 19, 2004

(87) PCT Pub. No.: WO03/090206

PCT Pub. Date: Oct. 30, 2003

(65) Prior Publication Data

US 2005/0254446 A1 Nov. 17, 2005

(30) Foreign Application Priority Data

Apr. 22, 2002 (EP) ..... 02076588
Jul. 12, 2002 (EP) ..... 02077863

(51) Int. Cl.
*H04R 5/00* (2006.01)

(52) U.S. Cl. ..... 381/20; 381/23; 704/200

(58) Field of Classification Search ..... 381/17–18, 381/19–23, 29; 704/200, 500–501, 208, 704/200.1, 219, 504, 229
See application file for complete search history.

(56) References Cited

U.S. PATENT DOCUMENTS

| | | | | |
|---|---|---|---|---|
| 5,172,415 | A * | 12/1992 | Fosgate | 381/22 |
| 5,263,087 | A * | 11/1993 | Fosgate | 381/28 |
| 6,496,584 | B2 * | 12/2002 | Irwan et al. | 381/18 |
| 6,895,093 | B1 * | 5/2005 | Ali | 381/66 |
| 6,973,184 | B1 * | 12/2005 | Shaffer et al. | 379/420.01 |
| 2002/0037086 | A1 * | 3/2002 | Irwan et al. | 381/307 |
| 2002/0118840 | A1 * | 8/2002 | Irwan et al. | 381/18 |

FOREIGN PATENT DOCUMENTS

| | | | |
|---|---|---|---|
| JP | 20024535145 | T | 11/2004 |
| WO | 03007656 | A1 | 1/2003 |
| WO | 03090206 | A1 | 10/2003 |
| WO | 2007010771 | A1 | 1/2007 |
| WO | 2007013775 | A1 | 2/2007 |
| WO | 2007013780 | A1 | 2/2007 |
| WO | 2007013781 | A1 | 2/2007 |
| WO | 2007013783 | A1 | 2/2007 |
| WO | 2007013784 | A1 | 2/2007 |

OTHER PUBLICATIONS

M. R. Schroeder; "synthesis of low-peak-factor and binary sequences with low correlation" (Jul. 30, 1969, IEEE).*

(Continued)

*Primary Examiner* — Devona E Faulk
*Assistant Examiner* — Disler Paul

(57) ABSTRACT

A method of synthesizing a first (L) and a second (R) output signal from an input signal (x). The method comprises: filtering (201) the input signal to generate a filtered signal; obtaining a correlation parameter indicative of a desired correlation between the first and second output signals; obtaining a level parameter (c) indicative of a desired level difference between the first and second input signals; and transforming the input signal and the filtered signal by a matrixing operation (203) into the first and second output signals, where the matrixing operation depends on the correlation parameter and the level parameter.

20 Claims, 3 Drawing Sheets

OTHER PUBLICATIONS

Faller C. et al, "Efficient representation of spatial audio using perceptual parametrization", IEEE Workshop on Applications of Signal Processing to Audio Acoustics, Oct. 2001, pp. 199-202.

Van Der Waal R. G. et al, "Subband coding of stereophonic digital audio signals", Speech Processing 2, VLSI, Underwater Signal Processing, Toronto, 1991, International Conference on Acoustics, Speech and Signal Processing, vol. 2, pp. 3601-3604.

Bosi M. et al., "ISO/IEC MPEG-2 Advanced Audio Coding", Journal of the Audio Engineering Society, New York, vol. 45, No. 10, 1997, pp. 789-812.

Schroeder M.R.,"Synthesis of low-peak-factor signals and binary sequences with low autocorrelation", IEEE Transact. Inf. Theor., 16:85-89, 1970.

* cited by examiner

SIGNAL SYNTHESIZING

This invention relates to the synthesizing of a first and a second output signal from an input signal.

Within the field of audio coding, parametric audio coders have gained increasing interest. It has been shown that transmitting (quantized) parameters that describe audio signals requires only little transmission capacity and that they allow a decoding at the receiving end which results in an audio signal that perceptually does not significantly differ from the original signal. Hence, bit-rate savings may be obtained by only transmitting one audio channel combined with a parameter bit stream that describes the spatial properties of the stereo signal and, thus, allows a decoder to reproduce the spatial properties of the stereo signal.

One of the above spatial parameters which is of importance for the coding of a stereo signal comprising an L channel and an R channel is the interchannel cross-correlation between the L and R channels. Hence, in many systems one of the signal parameters that are analysed by an encoder is the interchannel cross-correlation. The determined cross-correlation is then transmitted together with a mono signal from the encoder to a corresponding decoder.

At the decoder two output signals are reconstructed which have the desired cross-correlation. Furthermore, it is desirable that the reconstruction only introduces little artifacts relative to the original stereo signal.

Various methods of decorrelating signals are known as such. FIG. 1 illustrates a so-called Lauridsen decorrelator. The Lauridsen decorrelator comprises an all-pass filter 101, e.g. a delay, which generates and possibly attenuates a delayed version of the waveform of the input signal x. The output $\otimes$ x of the filter 101 is subsequently added (102) to the input resulting in the left channel L and subtracted (103) from the input resulting in the right channel R.

The above prior art decorrelator is very suitable as long as the two output signals are very similar or even equal in level. However, parametric audio coders also apply level differences to the output signals, the so-called amplitude panning. The above decorrelator involves the problem that the perceptual quality of the generated signals deteriorates if the level differences are large.

The above and other problems are solved by a method of synthesizing a first and a second output signal from an input signal, the method comprising:

filtering the input signal to generate a filtered signal;

obtaining a correlation parameter indicative of a desired correlation between the first and second output signals;

obtaining a level parameter indicative of a desired level difference between the first and second output signals; and transforming the input signal and the filtered signal by a matrixing operation into the first and second output signals, where the matrixing operation depends on the correlation parameter and the level parameter.

Hence, by performing a matrix operation which depends both on the desired correlation and the desired level difference, a significant increase in perceptual quality of the output signals of a parametric decoder is achieved.

In a preferred embodiment, the matrixing operation comprises a common rotation by a predetermined angle of the first and second output signals in a space spanned by the input signal and the filtered input signal; and where the predetermined angle depends on the level parameter.

Hence, By adding an additional rotation to the mixing operation, the relative level of the output signals may be controlled without influencing the cross-correlation between the output signals.

In a further preferred embodiment, the predetermined angle is selected to maximize a total contribution of the input signal to the first and second output signals. It is realized that the perceptual quality of the signal may be increased, if the amount of the filtered signal present in the output signals is minimized and, thus, the amount of the original signal is maximized.

When the method further comprises scaling each of the first and second output signals to said desired level difference between the first and second output signals, it is ensured that the relative level of the output signals corresponds to the desired level according to a level parameter determined by the encoder.

In a preferred embodiment, the filtering of the input signal comprises all-pass filtering the input signal, e.g. a comb-filter. The spectral spacing of a comb-filter is uniformly distributed over frequency. Hence to be able to obtain a desired dense spacing of peaks and valleys at low frequencies, the delay of the Lauridsen decorrelator should be very large. This, however, has the disadvantage that at high frequencies, echos can be perceived for transient input signals.

This problem may be solved when the all-pass filter comprises a frequency-dependant delay. At high frequencies, a relatively small delay is used, resulting in a coarse frequency resolution. At low frequencies, a large delay results in a dense spacing of the comb filter.

The filtering may be performed on the full bandwidth of the signal. Alternatively, the filtering may be combined with a band-limiting filter, thereby applying the decorrelation to one or more selected frequency bands.

The term matrix operation refers to an operation which transforms an input multi-channel signal into an output multi-channel signal where the components of the output multi-channel signal are linear combinations of the components of the input multi-channel signal.

The present invention can be implemented in different ways including the method described above and in the following, arrangements for encoding and decoding, and further product means, each yielding one or more of the benefits and advantages described in connection with the first-mentioned method, and each having one or more preferred embodiments corresponding to the preferred embodiments described in connection with the first-mentioned method and disclosed in the dependant claims.

It is noted that the features of the method described above and in the following may be implemented in software and carried out in a data processing system or other processing means caused by the execution of computer-executable instructions. The instructions may be program code means loaded in a memory, such as a RAM, from a storage medium or from another computer via a computer network. Alternatively, the described features may be implemented by hard-wired circuitry instead of software or in combination with software.

The invention further relates to an arrangement for synthesizing a first and a second output signal from an input signal, the arrangement comprising:

filter means for filtering the input signal to generate a filtered signal;

means for obtaining a correlation parameter indicative of a desired correlation between the first and second input signals;

means for obtaining a level parameter indicative of a desired level difference between the first and second input signals; and means for transforming the input signal and the filtered signal by a matrixing operation into the first and second output signals, where the matrixing operation depends on the correlation parameter and the level parameter.

The invention further relates to an apparatus for supplying a decoded audio signal, the apparatus comprising:

an input unit for receiving an encoded audio signal;

a decoder for decoding the encoded audio signal, the decoder comprising an arrangement for synthesizing a first and a second audio signal as described above and in the following; and an output unit for providing the decoded first and second audio signal.

The invention further relates to a decoded multi-channel signal comprising a first and a second signal component synthesized from an input signal by transforming the input signal and a filtered signal by a matrixing operation into the first and second signal components, where the filtered signal is generated by filtering the input signal, and where the matrixing operation depends on a correlation parameter indicative of a desired correlation between the first and second input signals and on a level parameter indicative of a desired level difference between the first and second input signals.

The invention further relates to a storage medium having stored thereon such a decoded multi-channel signal.

These and other aspects of the invention will be apparent and elucidated from the embodiments described in the following with reference to the drawing in which.

Figure 3A:
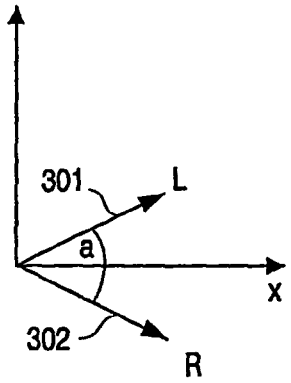
Figure 3B:
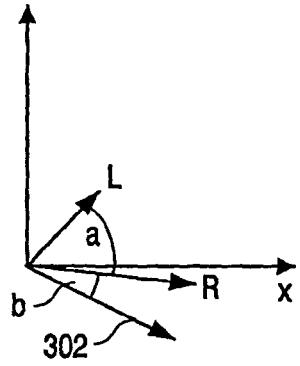
Figure 3C:
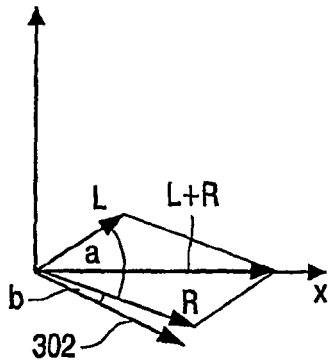
Figure 4:
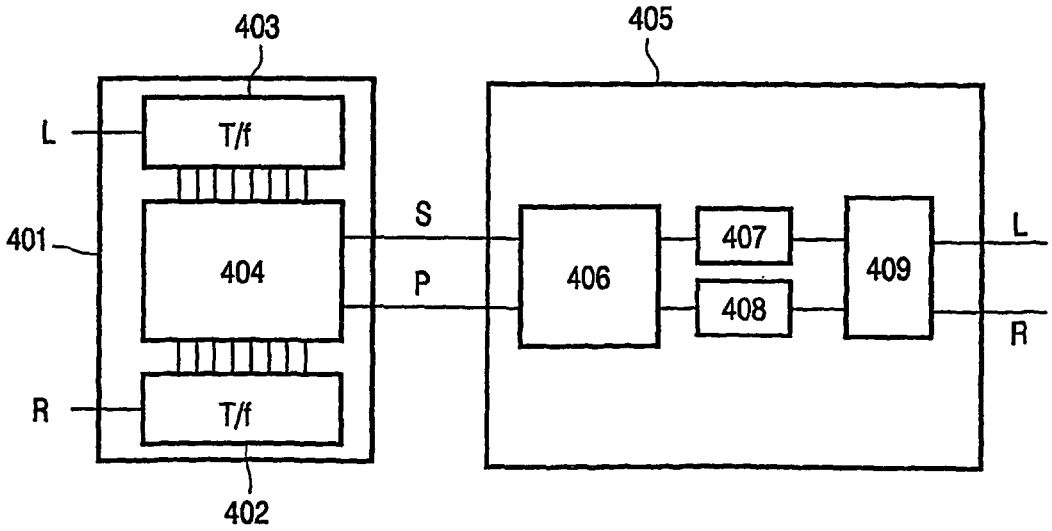

FIGS. 3*a-c* illustrate the signal generation according to an embodiment of the invention;

FIG. 4 schematically shows a system for spatial audio coding; and

Figure 2:
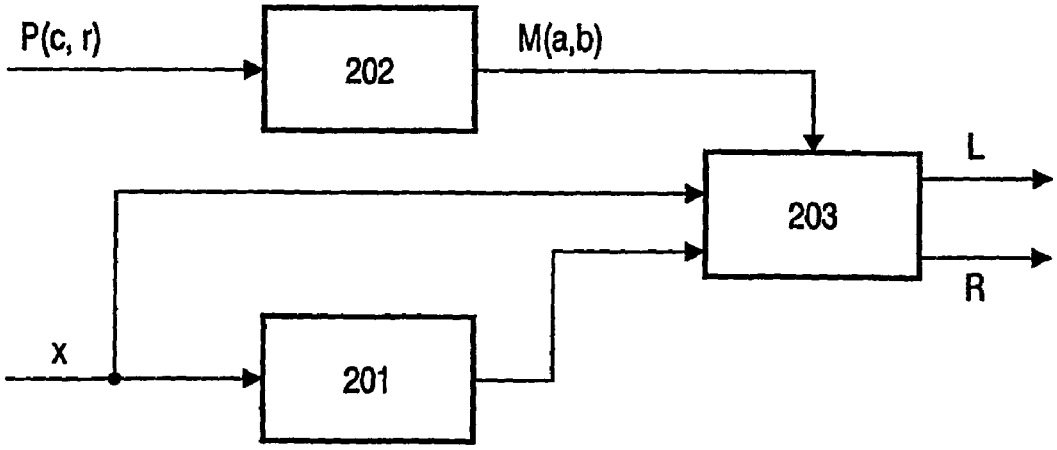
FIG. 2 illustrates a decorrelator according to an embodiment of the invention.
Figure 5:
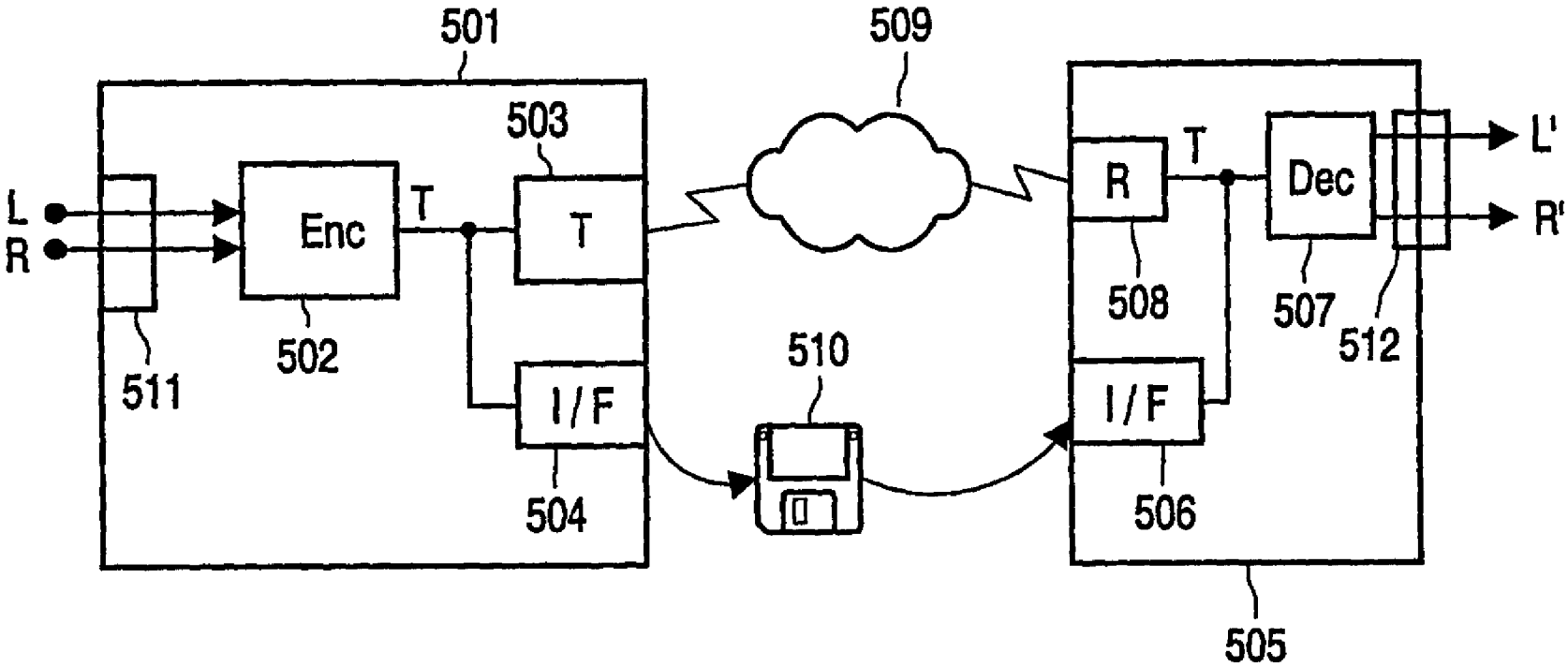

FIG. 5 shows a schematic view of a system for communicating multi-channel audio signals;

FIG. 2 illustrates a decorrelator according to an embodiment of the invention. The decorrelator comprises an all-pass filter 201 receiving an input signal x, e.g. from a parametric audio encoder which generates a mono audio signal x and a set of parameters P including an interchannel cross-correlation ρ and a parameter indicative of the channel difference c. Preferably, the all-pass filter comprises a frequency-dependant delay providing a relatively smaller delay at high frequencies than at low frequencies. This may be achieved by replacing a fixed-delay of the all-pass filter with an all-pass filter comprising one period of a Schroeder-phase complex (see e.g. M. R. Schroeder, "Synthesis of low-peak-factor signals and binary sequences with low autocorrelation", IEEE Transact. Inf. Theor., 16:85-89, 1970). The decorrelator further comprises an analysis circuit 202 that receives the spatial parameters from the decoder and extracts the interchannel cross-correlation ρ and the channel difference c. The circuit 202 determines a mixing matrix M(α,β) as will be described in connection with FIGS. 3*a-c*. The components of the mixing matrix are fed into a transformation circuit 203 which further receives the input signal x and the filtered signal H⊗x. The circuit 203 performs a mixing operation according to $$\begin{pmatrix} L \\ R \end{pmatrix} = M(\alpha, \beta) \cdot \begin{pmatrix} x \\ H \otimes x \end{pmatrix} \tag{1}$$

resulting in the output signals L and R.

FIGS. 3*a-c* illustrate the signal generation according to an embodiment of the invention. In FIG. 3*a* the input signal x is represented by the horizontal axis while the filtered signal H⊗x is represented by the vertical axis. As the two signals are uncorrelated they may be represented as orthogonal vectors spanning a two-dimensional space.

The output signals L and R are represented as vectors 301 and 302, respectively. In this representation, the correlation between the signals L and R is given by the angle α between the vectors 301 and 302 according to ρ=cos(α), i.e. by the angular distance α between the vectors 301 and 302. Consequently, any pair of vectors that exhibits the correct angular distance has the specified correlation.

Hence, a mixing matrix M which transforms the signals x and H⊗x into signals L and R with a predetermined correlation ρ may be expressed as follows:

$$M = \begin{pmatrix} \cos(\alpha/2) & \sin(\alpha/2) \\ \cos(-\alpha/2) & \sin(-\alpha/2) \end{pmatrix}. \tag{2}$$

Thus, the amount of all-pass filtered signal depends on the desired correlation. Furthermore, the energy of the all-pass signal component is the same in both output channels (but wit a 180° phase shift).

Figure 1:
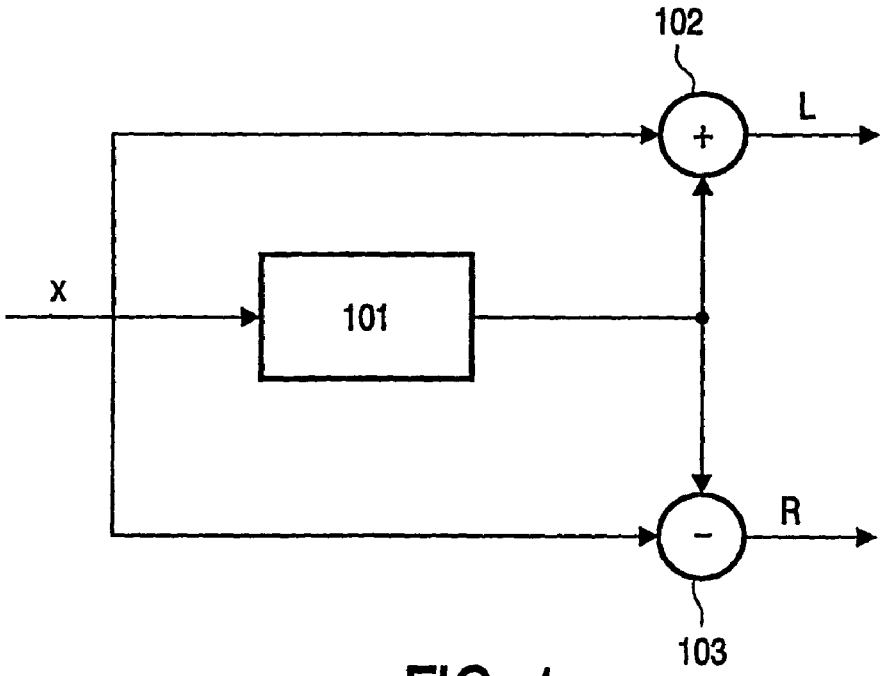
FIG. 1 shows a prior art Lauridsen decorrelartor.

It is noted that the Lauridsen decorrelator of FIG. 1 corresponds to the case where the matrix M is given by $$M = \sqrt{2} \cdot \begin{pmatrix} 1 & 1 \\ 1 & -1 \end{pmatrix}, \tag{3}$$

i.e. α=90° corresponding to uncorrelated output signals (ρ=0).

In order to illustrate a problem with the matrix of eqn. (3), we assume a situation with an extreme amplitude panning towards the left channel, i.e. a case where a certain signal is present in the left channel only. We further assume that the desired correlation between the outputs is zero. In this case, the output of the left channel of the transformation of eqn. (1) with the mixing matrix of eqn. (3) yields $L=1/\sqrt{2}(x+H\otimes x)$. Thus, the output consists of the original signal x combined with its all-passed filtered version H⊗x.

However, this is an undesired situation, since the all-pass filter usually deteriorates the perceptual quality of the signal. Furthermore, the addition of the original signal and the filtered signal results in comb-filter effects, such as perceived coloration of the output signal. In this assumed extreme case, the best solution would be that the left output signal consists of the input signal. This way the correlation of the two output signals would still be zero.

In situations with more moderate level differences, the preferred situation is that the louder output channel contains relatively more of the original signal, and the softer output channel contains relatively more of the filtered signal. Hence, in general, it is preferred to maximize the amount of the original signal present in the two outputs together, and to minimize the amount of the filtered signal.

According to the invention, this is achieved by introducing a different mixing matrix including an additional common rotation:

$$M = C \cdot \begin{pmatrix} \cos(\beta+\alpha/2) & \sin(\beta+\alpha/2) \\ \cos(\beta-\alpha/2) & \sin(\beta-\alpha/2) \end{pmatrix}. \tag{4}$$

Here β is an additional rotation, and C is a scaling matrix which ensures that relative level difference between the output signals equals c, i.e.

$$C = \begin{pmatrix} \frac{c}{1+c} & 0 \\ 0 & \frac{1}{1+c} \end{pmatrix}.$$

Inserting the matrix of eqn. (4) in eqn. (1) yields the output signals generated y the matrixing operation according to the invention:

$$\begin{pmatrix} L \\ R \end{pmatrix} = \begin{pmatrix} \frac{c}{1+c} & 0 \\ 0 & \frac{1}{1+c} \end{pmatrix} \cdot \begin{pmatrix} \cos(\beta+\alpha/2) & \sin(\beta+\alpha/2) \\ \cos(\beta-\alpha/2) & \sin(\beta-\alpha/2) \end{pmatrix} \cdot \begin{pmatrix} x \\ H \otimes x \end{pmatrix}.$$

This situation is illustrated in FIG. 3*b*. The output signals L and R still have an angular difference α, i.e. the correlation between the L and R signals is not affected by the scaling of the signals L and R according to the desired level difference and the additional rotation by the angle β of both the L and the R signal.

As mentioned above, preferably, the amount of the original signal x in the summed output of L and R should be maximized. This condition may be used to determine the angle β, according to $$\frac{\partial(L+R)}{\partial x} = 0,$$

which yields the condition:

$$\tan(\beta) = \frac{1-c}{1+c} \cdot \tan(\alpha/2).$$

This situation is illustrated in FIG. 3*c*, where the sum of the L and R components is aligned with the direction of x.

FIG. 4 schematically shows a system for spatial audio coding. The system comprises an encoder 401 and a corresponding decoder 405. The encoder 401 describes the spatial attributes of a multi-channel audio signal by specifying an interaural level difference, an interaural time (or phase) difference, and a maximum correlation as a function of time and frequency, as is described in European patent application no. 02076588.9, filed on 22 Apr. 2002. The encoder 401 receives the L and R components of a stereo signal as inputs. Initially, by time/frequency slicing circuits 402 and 403, the R and L components, respectively, are split up into several time/frequency slots, e.g. by time-windowing followed by a transform operation.

In one embodiment, The left and right incoming signals are split up in various time frames (e.g. 2048 samples at 44.1 kHz sampling rate) and windowed with a square-root Hanning window. Subsequently, FFTs are computed. The negative FFT frequencies are discarded and the resulting FFTs are subdivided into groups (subbands) of FFT bins. The number of FFT bins that are combined in a subband depends on the frequency: At higher frequencies more bins are combined than at lower frequencies. For example, FFT bins corresponding to approximately 1.8 ERBs (Equivalent Rectangular Bandwidth) may be grouped, resulting in e.g. 20 subbands to represent the entire audible frequency range.

Subsequently, in the analysis circuit 404, for every time/frequency slot, the following properties of the incoming signals are analyzed:

The interaural level difference, or ILD, defined by the relative levels of the corresponding band-limited signals stemming from the two inputs, The interaural time (or phase) difference (ITD or IPD), defined by the interaural delay (or phase shift) corresponding to the peak in the interaural cross-correlation function, and The (dis)similarity of the waveforms that can not be accounted for by ITDs or ILDs, which can be parameterized by the maximum value of the cross-correlation function (i.e., the value of the cross-correlation function at the position of the maximum peak).

The three parameters described above vary over time; however, since it is known that the binaural auditory system is very sluggish in its processing, the update rate of these properties is rather low (typically tens of milliseconds).

The analysis circuit 404 further generates a sum (or dominant) signal S comprising a combination of the left and right signals. Hence, the L and R signals are encoded as the sum signal S and a set of parameters P as a function of frequency and time, the parameters P comprising the ILD, the ITD/IPD, and the maximum value of the cross-correlation function.

It is noted that parameter ILD in this embodiment is related to the channel difference parameter c in the embodiment of FIG. 2 by ILD=k·log(c), where k is a constant, i.e. ILD is proportional to the logarithm of c.

In one embodiment, for each subband, the corresponding ILD, ITD and correlation ρ are computed. The ITD and correlation are computed simply by setting all FFT bins which belong to other groups to zero, multiplying the resulting (band-limited) FFTs from the left and right channels, followed by an inverse FFT transform. The resulting cross-correlation function is scanned for a peak within an interchannel delay between −64 and +63 samples. The internal delay corresponding to the peak is used as ITD value, and the value of the cross-correlation function at this peak is used as interaural correlation of this subband. Finally, the ILD is simply computed by taking the power ratio of the left and right channels for each subband.

The sum signal S may be generated by summing the left and right subbands after a phase correction (temporal alignment). This phase correction follows from the computed ITD for that subband and consists of delaying the left-channel subband with ITD/2 and the right-channel subband with −ITD/2. The delay is performed in the frequency domain by appropriate modification of the phase angles of each FFT bin. Subsequently, the sum signal is computed by adding the phase-modified versions of the left and right subband signals. Finally, to compensate for uncorrelated or correlated addition, each subband of the sum signal is multiplied with sqrt (2/(1+ρ)), with ρ the correlation of the corresponding subband. If necessary, the sum signal can be converted to the time domain by (1) inserting complex conjugates at negative frequencies, (2) inverse FFT, (3) windowing, and (4) overlap-add.

Preferably, the spatial parameters are quantized to reduce the required bit rate for their transmission.

The sum signal S and the parameters P are communicated to a decoder 405. The decoder 405 comprises a decorrelator circuit 406 which modifies the correlation between the left and right signals as described in connection with FIG. 2. The decoder further comprises delay circuits 407 and 408 which delay each subband of the left signal by −ITD/2 and each subband of the right signal by ITD/2, respectively, given the (quantized) ITD corresponding to that subband. The decoder further comprises circuit 409 which scales the subbands according to the IUD for that subband and converts the output signals to the time domain, e.g. by performing the following steps: (1) inserting complex conjugates at negative frequencies, (2) inverse IFT, (3) windowing, and (4) overlap-add.

FIG. 5 shows a schematic view of a system for communicating stereo audio signals according to an embodiment of the invention. The system comprises a coding device 501 for generating a coded audio signal and a decoding device 505 for decoding a received coded signal into a stereo signal. The coding device 501 and the decoding device 505 each may be any electronic equipment or part of such equipment.

Here, the term electronic equipment comprises computers, such as stationary and portable PCs, stationary and portable radio communication equipment and other handheld or portable devices, such as mobile telephones, pagers, audio players, multimedia players, communicators, i.e. electronic organizers, smart phones, personal digital assistants (PDAs), handheld computers, or the like. It is noted that the coding device 501 and the decoding device may be combined in one electronic equipment where audio signals are stored on a computer-readable medium for later reproduction.

The coding device 501 comprises an input unit 511 for receiving a stereo signal, an encoder 502 for encoding a stereo audio signal including a left signal component L and a right signal component R. The encoder 502 receives the two signal components via the input unit 511 and generates a coded signal T. The stereo signal may originate from a set of microphones, e.g. via further electronic equipment, such as a mixing equipment, etc. The signals may further be received as an output from another audio player, over-the-air as a radio signal, or by any other suitable means. An example of such an encoder was described in connection with FIG. 4 above.

According to one embodiment, the encoder 502 is connected to a transmitter 503 for transmitting the coded signal T via a communications channel 509 to the decoding device 505. The transmitter 503 may comprise circuitry suitable for enabling the communication of data, e.g. via a wired or a wireless data link 509. Examples of such a transmitter include a network interface, a network card, a radio transmitter, a transmitter for other suitable electromagnetic signals, such as an LED for transmitting infrared light, e.g. via an IrDa port, radio-based communications, e.g. via a Bluetooth transceiver, or the like. Further examples of suitable transmitters include a cable modem, a telephone modem, an Integrated Services Digital Network (ISDN) adapter, a Digital Subscriber Line (DSL) adapter, a satellite transceiver, an Ethernet adapter, or the like. Correspondingly, the communications channel 509 may be any suitable wired or wireless data link, for example of a packet-based communications network, such as the Internet or another TCP/IP network, a short-range communications link, such as an infrared link, a Bluetooth connection or another radio-based link.

Further examples of the communications channel include computer networks and wireless telecommunications networks, such as a Cellular Digital Packet Data (CDPD) network, a Global System for Mobile (GSM) network, a Code Division Multiple Access (CDMA) network, a Time Division Multiple Access Network (TDMA), a General Packet Radio service (GPRS) network, a Third Generation network, such as a UMTS network, or the like.

Alternatively or additionally, the coding device may comprise one or more other interfaces 504 for communicating the coded stereo signal T to the decoding device 505. Examples of such interfaces include a disc drive for storing data on a computer-readable medium 510, e.g. a floppy-disk drive, a read/write CD-ROM drive, a DVD-rive, etc. Other examples include a memory card slot a magnetic card reader/writer, an interface for accessing a smart card, etc.

Correspondingly, the decoding device 505 comprises a corresponding receiver 508 for receiving the signal transmitted by the transmitter and/or another interface 506 for receiving the coded stereo signal communicated via the interface 504 and the computer-readable medium 510. The decoding device further comprises a decoder 507 which receives the received signal T and decodes it into corresponding components L' and R' of a decoded stereo signal. A preferred embodiment of such a decoder according to the invention was described in connection with FIG. 4 above. The decoding device further comprises an output unit 512 for outputting the decoded signals which may subsequently be fed into an audio player for reproduction via a set of loudspeakers, or the like.

It is noted that the above arrangements may be implemented as general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

It should be noted that the above-mentioned embodiments illustrate rather than limit the invention, and that those skilled in the art will be able to design many alternative embodiments without departing from the scope of the appended claims.

For example, the invention is not limited to stereophonic signals, but may also be applied to other multi-channel input signals having two or more input channels. Examples of such multi-channel signals include signals received from a Digital Versatile Disc (DVD) or a Super Audio Compact Disc, etc.

In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements.

The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. In a decorrelator, a method of synthesizing a first and a second output signal from an input signal, the method comprising:

applying the input signal to a filter of the decorrelator to generate a filtered signal;

obtaining from an analysis circuit of the decorrelator a correlation parameter indicative of a desired correlation between the first and second output signals;

obtaining from the analysis circuit of the decorrelator a level parameter indicative of a desired level difference between the first and second output signals; and applying the input signal and the filtered signal to a transformation circuit of the decorrelator and performing by a matrixing operation on the input signal and the filtered signal to transform the input signal and the filtered signal into the first and second output signals, where the matrixing operation employs the correlation parameter and the level parameter.

2. A method according to claim 1, wherein the matrixing operation comprises a common rotation by a predetermined angle of the first and second output signals in a space spanned by the input signal and the filtered input signal;

and where the predetermined angle depends on the level parameter.

3. A method according to claim 2, wherein the predetermined angle is selected to maximize a total contribution of the input signal to the first and second output signals.

4. A method according to claim 1, further comprising scaling each of the first and second output signals to said desired level difference between the first and second output signals.

5. A method according to claim 1, wherein the filtering of the input signal comprises all-pass filtering the input signal.

6. A method according to claim 5, wherein the all-pass filter comprises a frequency-dependant delay.

7. The method of claim 1, wherein applying the input signal to the filter to generate the filtered signal comprises applying the input signal to an all-pass filter.

8. The method of claim 7, wherein applying the input signal to the all-pass filter to generate the filtered signal comprises applying the input signal to the all-pass filter wherein the all-pass filter provides a frequency-dependent delay element wherein the delay at a frequency Y is less than a delay at a frequency X, when Y>X.

9. The method of claim 7, wherein applying the input signal to the all-pass filter to generate the filtered signal comprises applying the input signal to the all-pass filter comprising one period of a Schroeder-phase complex.

10. The method of claim 1, wherein the matrixing operation on the input signal and the filtered signal comprises multiplying the input signal and the filtered signal by:

$$\begin{pmatrix} \frac{c}{1+c} & 0 \\ 0 & \frac{1}{1+c} \end{pmatrix} \cdot \begin{pmatrix} \cos(\beta+\alpha/2) & \sin(\beta+\alpha/2) \\ \cos(\beta-\alpha/2) & \sin(\beta-\alpha/2) \end{pmatrix},$$

where the first output signal is L, and the second output signal is R, where c=|L−R|, where αis an angular difference between L and R, and where $$\beta = \tan^{-1}\left[\left(\frac{1-c}{1+c}\right)\cdot\tan(\alpha/2)\right].$$

11. A device for synthesizing a first and a second output signal from an input signal, the arrangement comprising:

a filter for filtering the input signal to generate a filtered signal;

an analyzer for obtaining a correlation parameter indicative of a desired correlation between the first and second output signals, and for obtaining a level parameter indicative of a desired level difference between the first and second output signals;

a transformation circuit for transforming the input signal and the filtered signal by a matrixing operation into the first and second output signals, where the matrixing operation depends on the correlation parameter and the level parameter.

12. The device of claim 11, further comprising an input unit for receiving an encoded audio signal;

a decoder for decoding the encoded audio signal to produce the input signal.

13. The device of claim 11, wherein the filter means comprises an all-pass filter.

14. The device of claim 13, wherein the all-pass filter provides a frequency-dependent delay element wherein the delay at a frequency Y is less than a delay at a frequency X, when Y>X.

15. The device of claim 13, wherein the all-pass filter comprises one period of a Schroeder-phase complex.

16. The device of claim 11, wherein the means for obtaining the correlation parameter and the means for obtaining the level parameter comprise an analysis circuit that receives a set of spatial parameters pertaining to the input signal including at least: (1) an interaural level difference (ILD) parameter; (2) at least one of an interaural time difference (ITD) parameter and an interaural phase difference (IPD) parameter; and (3) a maximum value of a cross-correlation function parameter, and extracts from the set of spatial parameters the correlation parameter and the level parameter.

17. The device of claim 11, wherein the transformation circuit is adapted to perform the matrixing operation on the input signal and the filtered signal by multiplying the input signal and the filtered signal by:

$$\begin{pmatrix} \frac{c}{1+c} & 0 \\ 0 & \frac{1}{1+c} \end{pmatrix} \cdot \begin{pmatrix} \cos(\beta+\alpha/2) & \sin(\beta+\alpha/2) \\ \cos(\beta-\alpha/2) & \sin(\beta-\alpha/2) \end{pmatrix},$$

where the first output signal is L, and the second output signal is R, where c=|L−R|, where α is an angular difference between L and R, and where $$\beta = \tan^{-1}\left[\left(\frac{1-c}{1+c}\right)\cdot\tan(\alpha/2)\right].$$

18. In a data processing system, a method of synthesizing a first and a second output signal from an input signal, the method comprising:

employing processing means of the data processing system to filter the input signal to generate a filtered signal;

employing the processing means to obtain a correlation parameter indicative of a desired correlation between the first and second output signals, and to obtain a level parameter indicative of a desired level difference between the first and second output signals; and employing the processing means to perform a matrixing operation on the input signal and the filtered signal to transform the input signal and the filtered signal into the first and second output signals, where the matrixing operation employs the correlation parameter and the level parameter.

19. The method of claim 18, wherein filtering the input signal to generate the filtered signal comprises performing an all-pass filter operation.

20. The method of claim 18, wherein the processing mean performs the matrixing operation on the input signal and the filtered signal by multiplying the input signal and the filtered signal by:

$$\begin{pmatrix} \frac{c}{1+c} & 0 \\ 0 & \frac{1}{1+c} \end{pmatrix} \cdot \begin{pmatrix} \cos(\beta+\alpha/2) & \sin(\beta+\alpha/2) \\ \cos(\beta-\alpha/2) & \sin(\beta-\alpha/2) \end{pmatrix},$$

where the first output signal is L, and the second output signal is R, where $c=|L-R|$, where $\alpha$ is an angular difference between L and R, and where $$\beta = \tan^{-1}\left[\left(\frac{1-c}{1+c}\right)\cdot\tan(\alpha/2)\right].$$

* * * * *